US005115786A

United States Patent [19]

Yamada

[11] Patent Number: 5,115,786

[45] Date of Patent: May 26, 1992

[54] FUEL INJECTION CONTROL SYSTEM

[75] Inventor: Akira Yamada, Iwata, Japan

[73] Assignee: Yamaha Hatsudoki Kabushiki Kaisha, Iwata, Japan

[21] Appl. No.: 633,101

[22] Filed: Dec. 21, 1990

[30] Foreign Application Priority Data

Dec. 27, 1989 [JP] Japan ..... 1-343769

[51] Int. Cl.[5] ..... F02M 67/00

[52] U.S. Cl. ..... 123/531; 123/DIG. 11; 239/112

[58] Field of Search ..... 123/DIG. 11, 531, 532, 123/533, 534; 239/106, 112, 585

[56] References Cited

U.S. PATENT DOCUMENTS 4,548,361 10/1985 Paschke ..... 239/106

4,823,756 4/1989 Ziejewski et al. ..... 123/531

4,846,114 7/1989 List ..... 123/531

4,892,065 1/1990 List ..... 123/531

*Primary Examiner*—Tony M. Argenbright

*Attorney, Agent, or Firm*—Ernest A. Beutler

[57] ABSTRACT

A fuel injection system including an arrangement for opening the injector valve after the engine has stopped so as to purge the injector of any accumulated fuel. The injection valve may be opened and closed through a number of repeated cycles which assist in the removal of carbon deposits or may be held open for a fixed time period. In addition, if the injector is of the air/fuel type, any compressed air in the chamber can be utilized to purge the fuel and also the opening of the injection valve will preclude the accumulation of air pressure in the system after the engine has been shut down.

12 Claims, 4 Drawing Sheets

FUEL INJECTION CONTROL SYSTEM

BACKGROUND OF THE INVENTION

This invention relates to a fuel injection control system and more particularly to an improved system for controlling a fuel injector to preclude against deleterious effects if fuel remains in the injector after the engine is shut off.

The use of fuel injection as a charge former for internal combustion engines is well known. It is also well known that fuel injection and particularly direct cylinder injection is particularly useful in two cycle engines in controlling their exhaust emissions and fuel economy. Although fuel injection systems have a wide variety of advantages, there are some problems, particularly with certain types of fuel injectors.

For example, one type of fuel injector includes a chamber into which fuel is injected. This chamber is then communicated with the engine through an injector valve that is opened and closed to control the injection directly to the engine. Oftentimes, air may also be charged into the chamber, either along with the fuel or at the same time the fuel is introduced. Although this type of injector is highly advantageous, when the engine is shut off, there tends to remain some residual fuel in the chamber and in the area between the injector valve and its seat. Since the engine will still be at an elevated temperature, this fuel may carbonize and cause problems on subsequent operation of the injector.

It is, therefore, a principal object of this invention to provide an improved fuel injector.

It is a further object of this invention to provide an improved fuel injector wherein residual fuel will not be retained in the injector when the engine is stopped.

With injectors of the type utilizing both air and fuel, the air pressure may also be existent in the chamber after the engine has been stopped. This can give rise to some problems in that an attempt to service the injector will cause this pressurized air to escape rapidly and may cause some damage.

It is, therefore, a further object of this invention to provide an improved air fuel injector wherein air is purged out of the chamber when the engine is shut down.

SUMMARY OF THE INVENTION

This invention is adapted to be embodied in a fuel injector having a chamber into which fuel is delivered. An injector valve communicates the chamber with the engine and is opened and closed to control the injection. In accordance with the invention, means are provided for operating the injector valve to open it and purge any residual fuel after the engine has been stopped.

A further feature of the invention is adapted to be embodied in a method of operating the fuel injector of the type described in the preceding paragraph.

DETAILED DESCRIPTION OF THE PREFERRED EMBODIMENTS OF THE INVENTION

Figure 1:
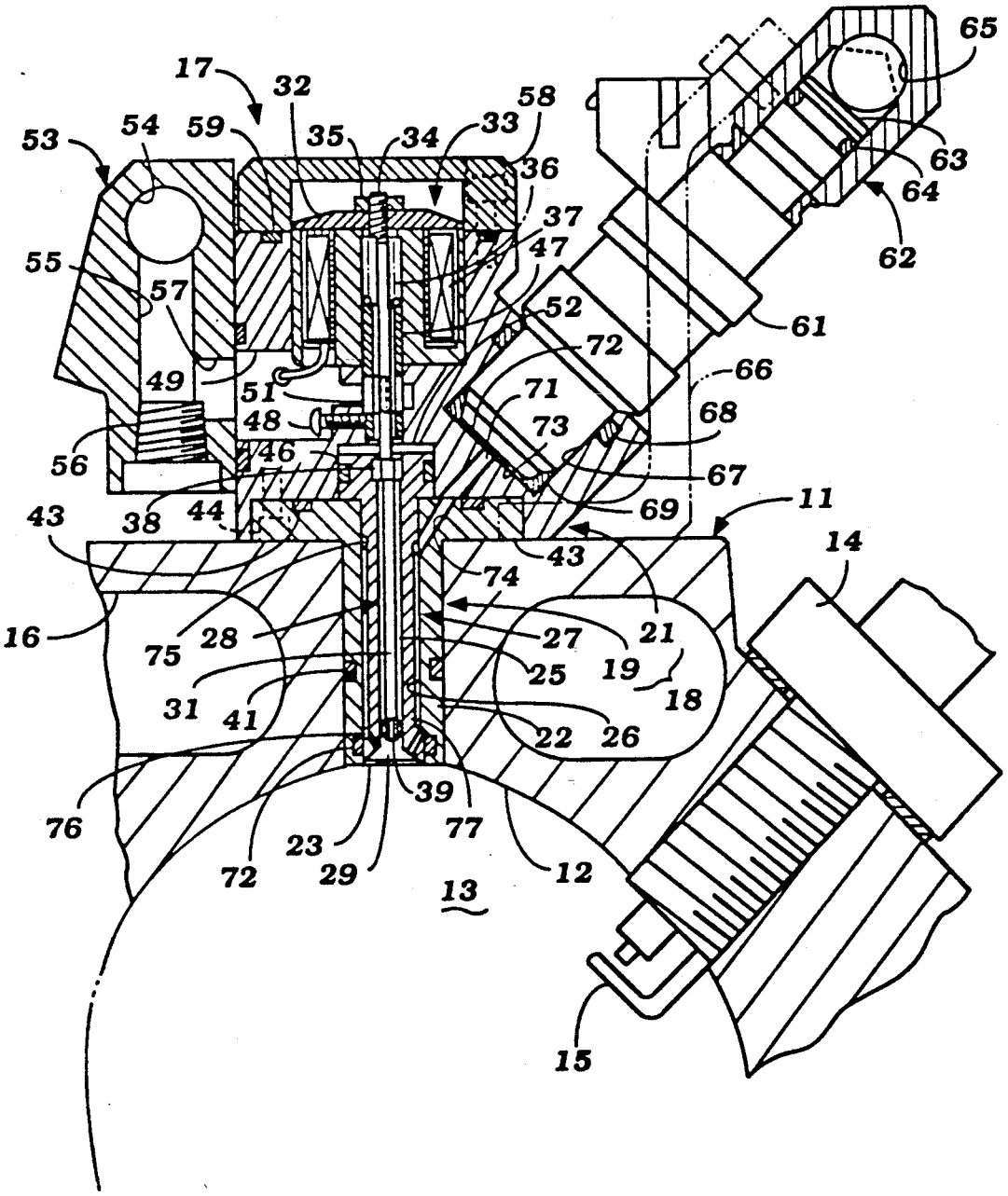
FIG. 1 is a partial cross sectional view taken through the combustion chamber of an engine having a fuel injection system constructed and operated in accordance with embodiments of the invention.

Referring first to FIG. 1, a portion of an internal combustion engine having a fuel injection system constructed and operated in accordance with the invention is partially depicted. Since the invention deals with the fuel injection system, illustration of the complete engine is not believed to be necessary in order to understand the construction and operation of the invention.

The engine depicted is of the two cycle crankcase compression type. Although the invention may be employed in conjunction with four cycle engines, it has particular utility in conjunction with two cycle engines.

The engine includes a cylinder head 11 which has a recess 12 which defines partially a combustion chamber 13. The combustion chamber 13 is defined by the cylinder head recess 12, the head of the piston and the cylinder bore (not shown). A spark plug 1 is threaded into the cylinder head 11 and has its gap 15 disposed appropriately in the combustion chamber 13. A cooling jacket 16 is formed in the cylinder head 11 and coolant is circulated through this cooling jacket in a known manner for engine cooling.

A fuel injector, indicated generally by the reference numeral 17, is mounted within a bore 18 formed in the cylinder head 11. In the illustrated embodiment, the injector 17 is a fuel/air injector. It is to be understood, however, that the invention may be employed with other types of fuel injectors than air/fuel injectors. For example, the invention may be utilized with injectors that inject only fuel, but the invention has particular utility in conjunction with air/fuel injectors.

The injector 17 includes a housing assembly, indicated generally by the reference numeral 18, which is comprised of a lower housing piece 19 and an upper housing piece 21. The lower housing piece 19 has a cylindrical portion 22 that is received within a suitable bore formed in the cylinder head 11 and terminates at a nozzle portion 23. The nozzle portion 23 is formed by an insert, indicated generally by the reference numeral 24, which has a cylindrical portion 25 that is disposed radially inwardly of a bore 26 formed in the cylindrical portion 22 of the lower housing portion piece 19. This forms a chamber 27 to which fuel is delivered, in a manner to be described. The nozzle opening 23 is formed by an enlarged diameter portion of the insert 24.

An injection valve, indicated generally by the reference numeral 28, has a head portion 29 that cooperates with the nozzle seat 23 so as to open and close it. The injection valve 28 has a reduced diameter portion 31 that extends through a bore in the insert piece 24 and which is connected at its upper end to an armature plate 32 of a solenoid assembly, indicated generally by the reference numeral 33. The upper end of the valve stem 31 is threaded as at 34 so as to receive a nut 35 to provide an adjustable connection to the armature plate 32.

A coil compression spring 36 acts against the armature plate 32 and urges the injection valve 28 to its normal closed position as shown in the drawing. A solenoid winding 37 encircles the upper end of the valve stem 31 and when energized will attract the armature plate 32 downwardly to compress the spring 36 and open the injection valve 28.

The valve stem 31 is provided with upper and lower extension lugs 38 and 39 that slidably engage the bore in the insert piece 24 so as to support the valve 28 for its reciprocal movement without interfering with the air flow therepast.

The cylindrical portion 22 of the housing piece 19 is formed with one or more annular grooves in which an O ring seal 41 is provided for sealing with the cylinder head 11. In a like manner, its internal surface is formed with an annular groove so as to receive an O ring seal 42 which seals with the enlarged end of the insert 24.

The housing piece 19 has an enlarged flange 43 formed at its upper end which is received within a counterbore formed in the lower face of the housing piece 21. Socket headed screws 44 affixed the housing pieces 19 and 21 to each other and an O ring seal 45 provides a seal between these pieces. The insert piece 22 has an enlarged headed portion 46 that is received within a bore formed in the housing piece 21 at the base of the counterbore which receives the flange 43 of the housing piece 19. Above this bore, the housing piece 21 is provided with a further bore that receives a sleeve 47 that is threaded to the core of the solenoid winding 37 and against which the coil compression spring 36 bears. This sleeve 47 provides a combined mounting function for the winding 37 and preload adjustment for the spring 36. The sleeve 47 is held in position by means of a lock screw 48 which is threaded through the housing piece 21 and which is accessible through an opening 49 formed in the side thereof. The opening 49 also admits air, in a manner to be described, which can flow through a slotted opening 51 in the sleeve 47 so as to be received in a gap 52 formed around the valve stem 31 and the interior of the insert piece 24.

The air is delivered to the opening 49 from an air manifold, indicated generally by the reference numeral 53, and which is affixed to the injector body. The air manifold 53 has a transversely extending passage 54, one end of which is connected to a regulated source of air pressure (not shown). The bore 54 is intersected by a crossbore 55, the outer end of which is closed by a plug 56. The manifold 53 is further provided with intersecting passages 57 which communicate with the opening 49 in the housing piece 21 so as to permit air under pressure to enter the aforenoted chamber 52.

Air leakage from around the solenoid 33 is precluded by means of a cap 58 that is affixed to the upper end of the housing piece 21 and which engages an O ring seal 59.

A fuel injector 61 is provided for the injector 17. The fuel injector 61 may be of any known type. Fuel is delivered to the fuel injector 61 by a fuel manifold 62 that is affixed to the tip 63 of the fuel injector 62 and which is sealed thereto by O ring seals 64. A manifold line 65 which communicates with a regulated pressure fuel source (not shown) delivers the fuel to the fuel injector 61. The fuel manifold 62 is mounted on a mounting bracket that is shown in phantom and which is identified by the reference numeral 66.

For ease of location, the housing piece 21 is formed with a bore 67 that is disposed at approximately a 45° angle to the axis of the injector valve 28. The bore 67 receives the nozzle portion of the injector 61. O ring seals 68 and 69 provide a sealing function around these nozzle portions so that the fuel which issues from the injector 61 will be directed toward a passage 71 bored into the housing piece 21. The passage extends from the bore 67 and specifically from a shoulder 72 formed at the base of this bore 67. The fuel injector nozzle end portion 73 is spaced slightly from the shoulder 72 so as to provide a chamber through which the fuel will be injected. By using this close spacing, no significant dead space exits between the injector nozzle and the passage 71. Dead space will be eliminated and better fuel injection control can be obtained.

The housing piece passage 71 is intersected by corresponding passage 74 formed in the housing piece 21. These passages terminate in an annular recess 75 formed in the periphery of the insert 24 so as to communicate the fuel with the chamber 27. At the lower end of the chamber 27, there is provided another annular relief 76 that is intersected by a plurality of ports 77 that extend through the lower end of the enlargement of the insert piece 24 at the valve seat 23. Hence, when the valve head 29 moves to its open position, both fuel and air will be valved into the combustion chambers 13.

It is to be understood that the amount of fuel injected can be varied in a wide variety of manners and the operation of the fuel injector 61 may be initiated either before the valve 28 is opened or after. Any such control strategies are within the spirit and scope of the invention. Also, the air pressure delivered to the port 54 can also be varied as desired so as to change the fuel/air injection characteristics. Again, this particular part of the strategy is not critical to the invention and the invention may be utilized in conjunction with any wide variety of strategies of varying air pressure and/or the timing and duration of operation of the injector 17.

Basically, the way the injector 17 operates is that air under pressure is always supplied by the manifold 53 and fuel is injected at a desired timing by the injector 61 into the chamber 27. The fuel and air will then be discharged into the combustion chamber 13 when the solenoid 33 and specifically its winding 37 is energized and the injection valve 28 is opened. As used in the specification and claims hereinafter, the term "initiation of injection" will be referred to as the time when the injection valve 28 is opened. This assumes that fuel will be supplied to the combustion chamber 13 at that time. This fuel may or may not have been precharged into the chamber 27 depending upon the specific control strategy. It may be that the fuel is supplied by the injector 61 simultaneously with opening of the injection valve 28.

Figure 2:
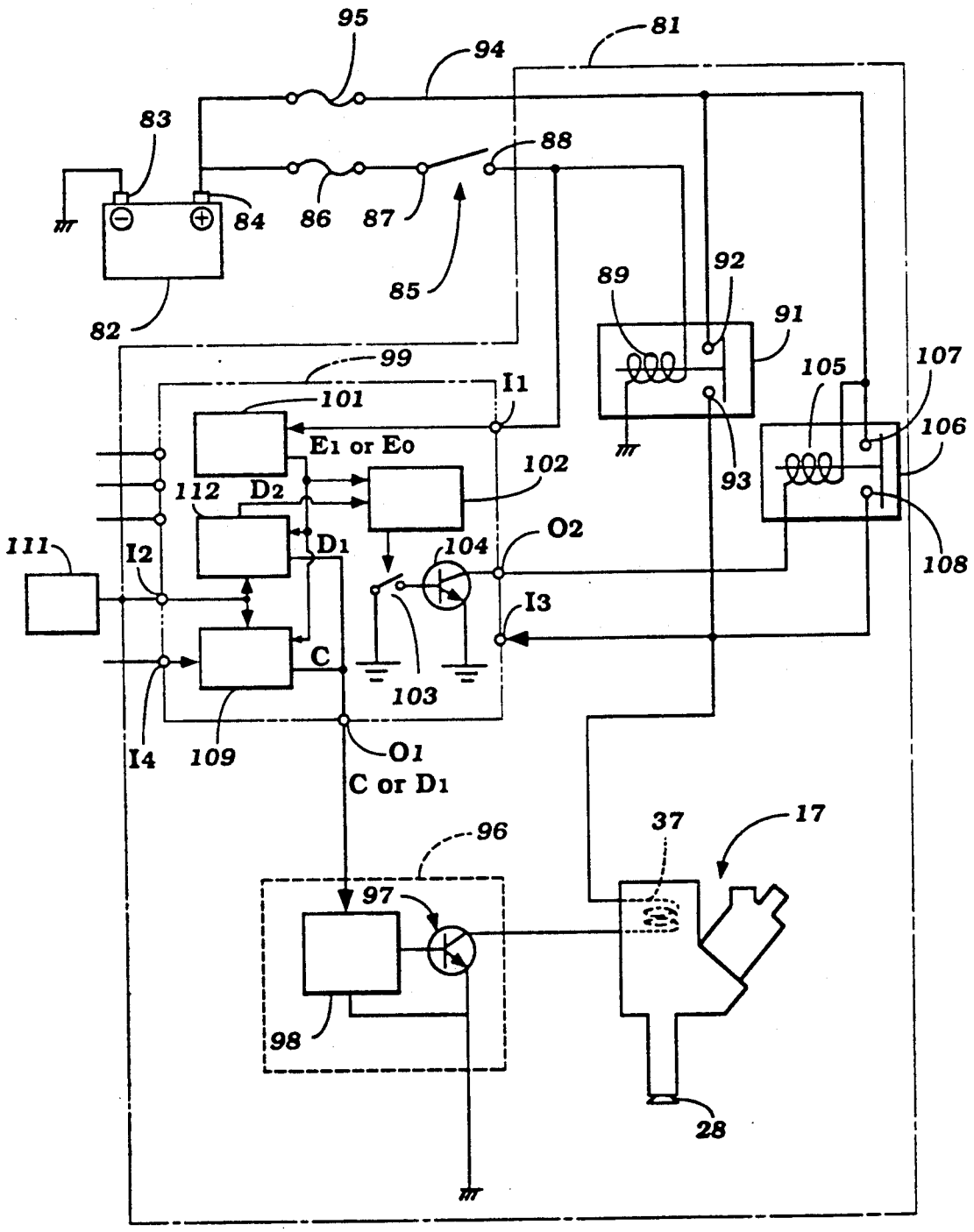
FIG. 2 is a schematic view showing the components of the injection control system.

The basic control for the system is shown schematically in FIG. 2 and will now be described by reference to that Figure. The fuel injector 17 and its control is indicated generally in the box shown in phantom and identified by the reference numeral 81. This control system is powered by a battery 82 which has its negative terminal 83 grounded and its positive terminal 84 connected to a main or master switch 85 through a protective fuse 86. The main switch 85 has a pair of terminals 87 and 88 which are normally opened, but when closed energize the winding 89 of a first main control switch 91 of the relay type. This switch 91 has a pair of terminals 92 and 93 which, when connected, connect a further conductor 94 in which a protective fuse 95 is positioned between the positive battery terminal 84 and the solenoid winding 87.

The second terminal of the solenoid winding 37 is connected to the ground through a solenoid actuating circuit, indicated by the reference numeral 96 and which includes a transistor 97 which is switched by a control circuit 98 between an on and off condition so as to selectively energize the solenoid 37 or switch it off.

There is provided a control circuit 99 for controlling the solenoid actuating circuit 96 and this circuit has a terminal $I_1$ that is connected to receive power when the main switch 85 is closed. This main power is then provided to a detecting circuit 101 which determines the condition of the main switch 85. If the main switch 85 is on or closed, then the detecting unit 101 outputs a signal $E_1$ indicating this condition which signal is transmitted to a switch control 102 which then closes a switch 103 to render a transistor 104 conductive. The transistor 104 is connected to an output port 02 of the control unit 99 and causes a solenoid 105 of a subcontrol switch 106 to be energized. This switch then closes the terminals 107 and 108 and connects the conductor 94 to an input port $I_3$ of the controller 99 to provide electrical power for the control unit 99.

At the same time, a main control portion 109 receives the actuating signal $E_1$ and outputs a control signal to the control circuit 98 for the transistor 97. The control unit 109 receives certain engine operating parameters from an input port $I_4$ and also engine speed indication from an engine speed sensor 111 through an input port $I_2$. In response to these signals, the main control portion 109 outputs a signal C to the control circuit 98 so as to switch the transistor 97 so as to provide the desired injection initiation and duration for the engine running condition.

In accordance with the invention, a construction is provided whereby when the main switch 85 is turned off after the engine has been running and once the engine has completely stopped, the injector valve 28 is again opened so as to permit any fuel which may have accumulated in the chamber 27 can be drained so as to prevent carbonization of the fuel in the injector. Also, this opening will relieve the air pressure and the air which may be trapped in the chamber 27 is utilized to expel the fuel. To this end, there is provided a subcontrol circuit 112 which receives the engine speed signal from the engine speed sensor 111 and will output a signal $D_2$ to the switch control 102 to open the switch 103 and discontinue the source of electrical power to actuate the solenoid 37. However, once the main switch 85 has been opened and the engine has been deemed to be stopped by the lack of an output from the speed sensor 111, then the subcontrol unit 112 outputs an actuating signal $D_1$ for actuating the solenoid control circuit 98 so as to energize the solenoid 37.

Figure 4:
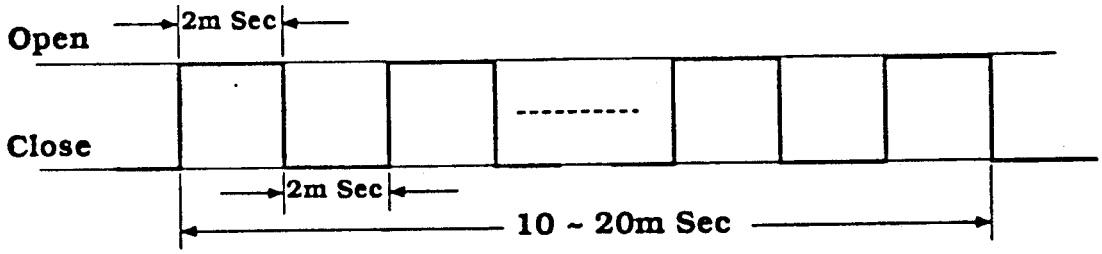
FIG. 4 is a diagram showing the pulses generated to the solenoid of the injector to open and close the injector valve after the engine has been shut down.

In one control routine, as shown in FIG. 4, the solenoid 37 is pulsed so that it will be switched on for two milliseconds, off for two milliseconds, on for two milliseconds, for a total number of approximately five to ten pulses so that the main injection valve 28 will be open for approximately ten to twenty milliseconds. This will insure good purging of the chamber 27. In addition, the rapid opening and closing of the injector valve 28 will cause any carbon particles which may have accumulated on it to be knocked off. Once the time period has elapsed, then the subcontrol unit 112 outputs a signal $D_2$ to the switch actuating circuit 102 so that the switch 103 will then be opened and the transistor 104 switched off so as to open the switch 106 and discontinue the operation.

Figure 5:
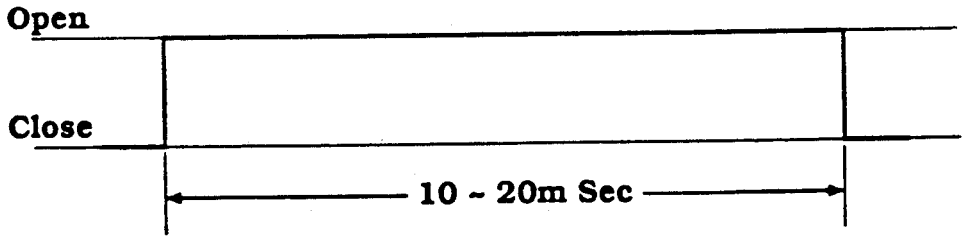
FIG. 5 is a diagram, in part similar to FIG. 4, and shows another embodiment of the invention.

Rather than providing a number of pulses, one long pulse can also be produced, as shown in FIG. 5, so as to hold the injection valve 28 open for a period of approximately ten to twenty milliseconds. This construction may insure better purging, but will not be as effective in removing carbon deposits as the previously described routine.

Figure 3:
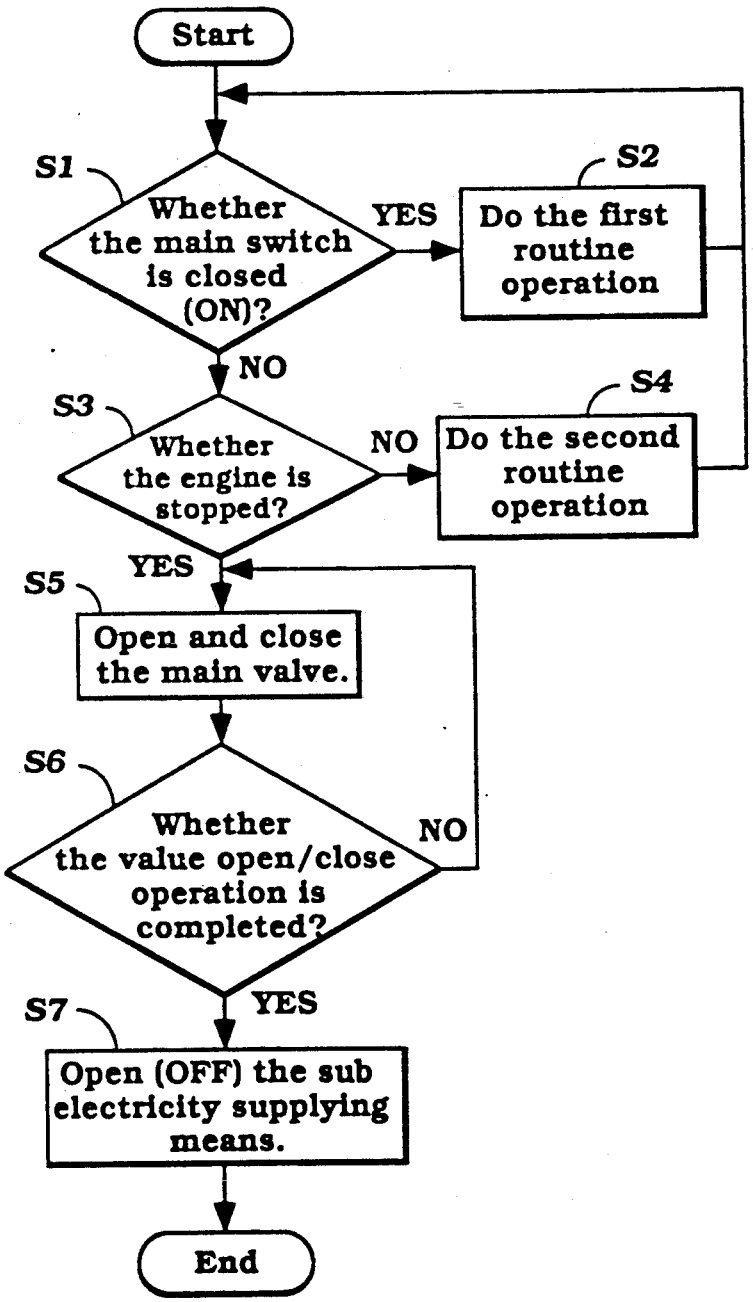
FIG. 3 is a block diagram showing the control routine in accordance with the invention.

The logic by which this circuit operates may be understood by reference to the block diagram of FIG. 3. As may be seen in this figure, when the program starts, it moves to the step S1 to determine if the main switch 85 is open by the main switch condition determining circuit 101. If the main switch 85 is on, the program moves to the step S2 to do the normal control routine for operating the solenoid 37 and the injector valve 28 in response to the engine operating parameters.

If at the step S1 it is determined that the main switch is off, the program moves to the step S3 to determine if the engine is stopped. This is done, as aforenoted, by checking the speed output of the engine speed sensor 111. If the engine has not stopped, the program moves to the step S4 so as to delay any pulsing or opening of the injection valve 28 and to maintain the switch 103 in its open or off condition.

If, however, the engine has been determined as being stopped at the step S3, the program moves to the step S5 to actuate the solenoid 37 either in the pulsed or continuous fashion as aforenoted. The program then moves to the step S6 to determine whether the time of opening of the injection valve 28 has run down. If so, the program then outputs the pulse $D_2$ at the step S7 so as to open the switch 103 by the switch actuating circuit 102. The program then ends.

It should be readily apparent from the foregoing description that this arrangement is very effective in not only purging fuel, but also air from an injection unit after the engine has stopped so as to avoid the deleterious effects of any fuel accumulation in the injector. Although two embodiments of the invention have been illustrated and described, various changes and modifications may be made without departing from the spirit and scope of the invention, as defined by the appended claims.

I claim:

1. A fuel injector for an internal combustion engine, said fuel injector comprising a chamber into which fuel is delivered, a nozzle port for communicating said chamber with said engine, an injector valve for controlling the flow through said nozzle port, means for determining whether said engine is running or not, and means for opening said injection valve when said engine has stopped for purging fuel from said chamber.

2. A fuel injector as set forth in claim 1 wherein the means for opening the injection valve opens and closes the injection valve in a number of cycles after the engine has stopped.

3. A fuel injector as set forth in claim 1 wherein the means for opening the injection valve holds the injection valve open for a finite time period after the engine has stopped.

4. A fuel injector as set forth in claim 1 wherein the injector is a fuel/air injector and further including means for delivering compressed air to the chamber.

5. A fuel injector as set forth in claim 4 wherein the means for opening the injection valve opens and closes the injection valve in a number of cycles after the engine has stopped.

6. A fuel injector as set forth in claim 4 wherein the means for opening the injection valve holds the injection valve open for a finite time period after the engine has stopped.

7. A method of operating a fuel injector for an internal combustion engine wherein the fuel injector comprising a chamber into which fuel is delivered, a nozzle port for communicating the chamber with the engine, an injector valve for controlling the flow through the nozzle port, comprising the steps of determining whether the engine is running or not, and opening the injection valve when the engine has stopped for purging fuel from the chamber.

8. A method as set forth in claim 7 wherein the injection valve is opened and closed for a number of cycles after the engine has stopped.

9. A method as set forth in claim 7 wherein the injection valve is held open for a finite time period after the engine has stopped.

10. A method as set forth in claim 7 wherein the fuel injector is a fuel/air injector including means for delivering compressed air to the chamber and the opening of the injector valve purges compressed air trapped in the chamber along with fuel.

11. A method as set forth in claim 10 wherein the injection valve is opened and closed for a number of cycles after the engine has stopped.

12. A method as set forth in claim 10 wherein the injection valve is held open for a finite time period after the engine has stopped.

* * * * *